US007284545B2

(12) United States Patent
Rösel et al.

(10) Patent No.: US 7,284,545 B2
(45) Date of Patent: Oct. 23, 2007

(54) DEVICE FOR CONTROLLING AN INTERNAL COMBUSTION ENGINE

(75) Inventors: Gerd Rösel, Regensburg (DE); Hong Zhang, Tegernheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/557,122

(22) PCT Filed: Nov. 10, 2004

(86) PCT No.: PCT/EP2004/052912

§ 371 (c)(1),
(2), (4) Date: Nov. 17, 2005

(87) PCT Pub. No.: WO2005/059342

PCT Pub. Date: Jun. 30, 2005

(65) Prior Publication Data

US 2006/0260592 A1 Nov. 23, 2006

(30) Foreign Application Priority Data

Dec. 16, 2003 (DE) ..... 103 58 988

(51) Int. Cl.
*F02D 41/14* (2006.01)

(52) U.S. Cl. ..... 123/673; 123/696; 701/109

(58) Field of Classification Search ..... 123/673, 123/694, 696; 701/109
See application file for complete search history.

(56) References Cited

U.S. PATENT DOCUMENTS 5,020,502 A 6/1991 Wild
6,325,056 B1 12/2001 Weining et al.
6,415,779 B1 * 7/2002 Colomby ..... 123/674
2002/0002970 A1 1/2002 Hosoya et al.

FOREIGN PATENT DOCUMENTS

| | | |
|---|---|---|
| DE | 38 00 176 A1 | 7/1989 |
| DE | 199 03 721 C1 | 7/2000 |
| DE | 102 21 376 A1 | 11/2003 |
| EP | 0802316 | 10/1997 |
| EP | 1 108 871 A1 | 6/2001 |
| EP | 1 132 599 A1 | 9/2001 |

* cited by examiner

*Primary Examiner*—T. M. Argenbright

(57) ABSTRACT

The invention relates to a device for controlling an internal combustion engine, comprising a first regulator, whose regulating difference is the difference of an actual value and an estimated value of individual cylinder deviation of the air/fuel ratio from a preset air/fuel ratio. The first regulator also has an integral regulating parameter, its manipulated variable being a first estimated value. A second regulator is also provided, the regulating difference of which is the first estimated value. Said regulator has a proportional regulating parameter whose manipulated variable is an individual cylinder lambda regulating factor. A PT1 filter is additionally provided, by means of which a second estimated value is determined through PT1 filtering of the individual cylinder lambda regulating factor. A unit is also provided, said unit determining the estimated value of the individual cylinder deviation of the air/fuel ratio from the preset air/fuel ratio based on the difference between the first and the second estimated values. Depending on the individual cylinder lambda regulating factor, a fuel mass that is to be proportioned is corrected and the thus corrected fuel mass to be proportioned is considered in order to determine a regulating signal for the corresponding injection valve.

10 Claims, 3 Drawing Sheets

DEVICE FOR CONTROLLING AN INTERNAL COMBUSTION ENGINE

CROSS REFERENCE TO RELATED APPLICATION

This application is the US National Stage of International Application No. PCT/EP2004/052912, filed Nov. 10, 2004 and claims the benefit thereof. The International Application claims the benefits of German Patent applications No. 10358988.0 DE filed Dec. 16, 2003, all of the applications are incorporated by reference herein in their entirety.

FIELD OF THE INVENTION

The invention relates to a device for controlling an internal combustion engine with a plurality of cylinders and injection valves assigned to the cylinders, which meter fuel, with an exhaust gas probe arranged in an exhaust gas manifold and having a measurement signal which is characteristic of the air/fuel ratio in the respective cylinder.

BACKGROUND OF THE INVENTION

The increasingly strict legal provisions relating to permitted pollutant emissions from vehicles containing internal combustion engines mean that it is necessary to minimize pollutant emissions as far as possible when the internal combustion engine is operating. This can be achieved on the one hand by reducing the pollutant emissions resulting during combustion of the air/fuel mixture in the respective cylinder in the internal combustion engine. On the other hand exhaust gas treatment systems are used in internal combustion engines to convert the pollutant emissions produced during the combustion process of the air/fuel mixture in the respective cylinders to harmless substances. Catalytic converters, which convert carbon monoxide, hydrocarbons and nitrogen oxide to harmless substances, are used for this purpose. A very precisely adjusted air/fuel ratio in the respective cylinder is required both to influence the production of pollutant emissions during combustion in a specific fashion and for the exhaust gas catalytic converter to convert the pollutant components with a high level of efficiency.

DE 199 03 721 C 1 discloses a method for a multicylinder internal combustion engine for regulating an air/fuel mixture to be burned in a cylinder-selective fashion, in which the lambda values for different cylinders or cylinder groups are detected and regulated separately. An individual regulator is assigned to every cylinder. This regulator is configured as a PI or PID regulator, its controlled variable is a cylinder-specific lambda value and its reference variable is a cylinder-specific target lambda value. The manipulated variable of the respective regulator then influences fuel injection in the respectively assigned cylinder.

EP 0 802 316 B 1 also discloses a method for controlling an internal combustion engine, with a regulator configured as a PID regulator, the controlled variable of which is an estimated value for a cylinder-specific air/fuel ratio determined by an observer and the reference variable of which is a correspondingly converted mean lambda control factor, evaluated with a target air/fuel ratio. The mean lambda control factor is determined by taking the mean of all the cylinder-specific lambda control factors. Each cylinder-specific lambda control factor is the manipulated variable of the respective PID regulator assigned to the cylinder. A corrected injection time is determined by multiplying an injection period predefined for all the cylinders in the internal combustion engine by the respective cylinder-specific lambda control factor.

SUMMARY OF THE INVENTION

The object of the invention is to create a device for controlling an internal combustion engine, which ensures precise control of the internal combustion engine.

The invention is distinguished by a device for controlling an internal combustion engine with a plurality of cylinders and injection valves assigned to the cylinders, which meter fuel, with an exhaust gas probe arranged in an exhaust gas manifold and having a measurement signal which is characteristic of the air/fuel ratio in the respective cylinder. A first regulator is provided, the regulating difference of which is the difference between an actual value and an estimated value of a cylinder-specific deviation of the air/fuel ratio from a predefinable air/fuel ratio. The first regulator also has an integral regulating parameter. The manipulated variable of the first regulator is a first estimated value. A second regulator is also provided, the regulating difference of which is the first estimated value and which has a proportional regulating parameter and the manipulated variable of which is a cylinder-specific lambda control factor. A PT1 filter is also provided, by means of which a second estimated value is determined by PT1 filtering of the cylinder-specific lambda control factor. A unit is provided to determine the estimated value of the cylinder-specific deviation of the air/fuel ratio from the predefinable air/fuel ratio from the difference between the first and second estimated values.

A block is provided to determine a fuel mass to be supplied, which is to be supplied to the respective cylinder of the internal combustion engine, as a function of a load variable and in which fuel mass to be supplied is then corrected as a function of the cylinder-specific lambda control factor. An actuating signal to control the injection valve is then generated in the block as a function of the corrected fuel mass to be supplied.

The second regulator with a P element can be used to increase the possible regulating speed compared with when the second regulator is configured as a further I regulator, connected downstream from the first regulator. The claimed device is also very robust with a very high level of regulating accuracy. This is for example due to the fact that the second estimated value takes into account the actual manipulated variable, by means of which the injection valve is activated. Application outlay is minor with the claimed device.

The invention is also distinguished by a device for controlling the internal combustion engine, with which a difference between an actual value and an estimated value of the cylinder-specific deviation of the air/fuel ratio from a predefinable air/fuel ratio is supplied to the second regulator as the regulating difference. The second regulator has a further integral regulating parameter. Its manipulated variable is the cylinder-specific lambda control factor. It is also ensured with this device that the second regulator can be operated at a high regulating speed and the device has a high level of robustness with a very high level of regulating accuracy. Application outlay is minor with the claimed device.

In an advantageous development of the invention a block is provided, which adjusts the first estimated value by means of a weighting factor, before it is supplied to the unit. A further block is also provided, which adjusts the cylinder-specific lambda control factor by means of a further weighting factor before it is supplied to the PT1 filter. This allows the cylinder-specific air/fuel ratio to be determined more precisely when determining the estimated value of the cylinder-specific deviation of the air/fuel ratio, in particular in respect of different cylinder outlet lengths to the exhaust gas probe assigned to all the cylinders or at least all the cylinders in a cylinder bank and in respect of a mix of the exhaust gases generated in the respective cylinders in the area of the exhaust gas probe.

In a further advantageous development of the invention the predefinable air/fuel ratio is a mean air/fuel ratio of all the cylinder-specific air/fuel ratios. The device can therefore ensure a very precise equalization of the air/fuel ratios in all the cylinders in the internal combustion engine.

In a further advantageous embodiment of the invention a third regulator is provided, the reference variable of which is an air/fuel ratio predefined for all the cylinders in the internal combustion engine, the controlled variable of which is the mean air/fuel ratio of all cylinder-specific air/fuel ratios and the manipulated variable of which is a lambda control factor. The predefined air/fuel ratio can therefore be set simply and precisely in all the cylinders.

In a further advantageous development of the invention the proportional regulating parameter or the further integral regulating parameter of the second regulator is predefined as a function of load. This allows the regulating quality to be enhanced in a simple fashion, as the different mix of the exhaust gases resulting from the individual combustion of the air/fuel mixtures in the respective cylinders Z1 -Z4 can be taken into account in a simple fashion.

BRIEF DESCRIPTION OF THE FIGURES

Exemplary embodiments of the invention are described in more detail below with reference to the schematic drawings, in which.

DETAILED DESCRIPTION OF THE INVENTION

Figure 1:
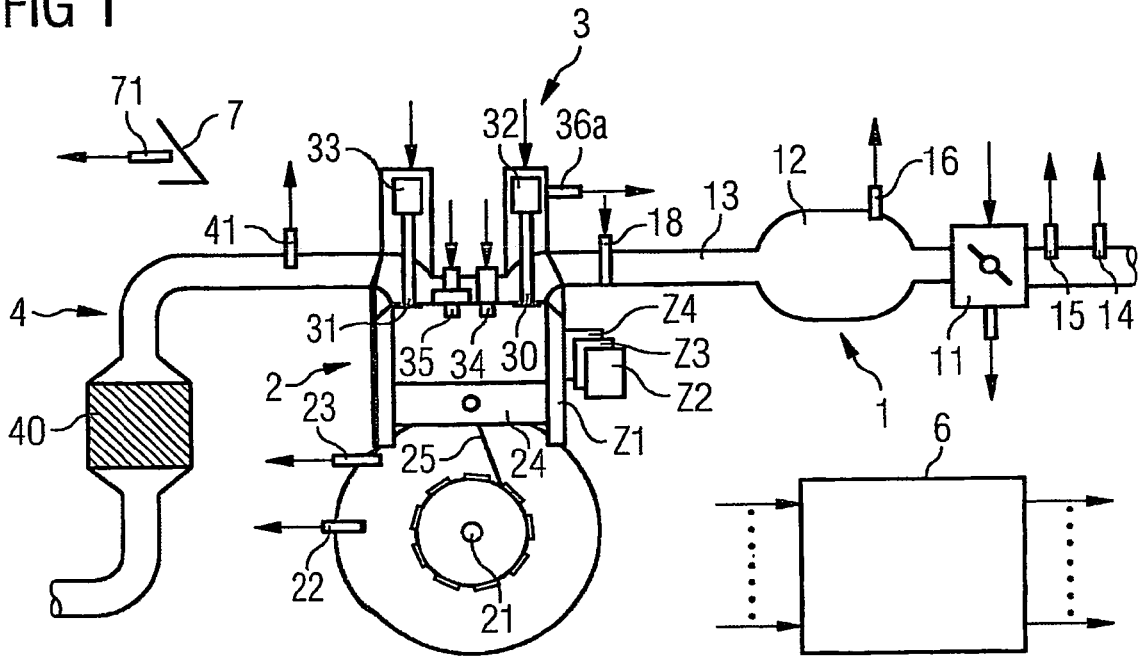
FIG. 1 shows an internal combustion engine with a control device.

Elements with the same structure and function are shown with the same reference characters in all the figures.

An internal combustion engine (FIG. 1) has an intake manifold 1, an engine block 2, a cylinder head 3 and an exhaust gas manifold 4. The intake manifold preferably has a throttle valve 11, as well as a collector 12 and a suction pipe 13, leading to a cylinder Z1 via an inlet duct into the engine block. The engine block also has a crankshaft 21, which is linked via a connecting rod 25 to the piston 24 of the cylinder Z1.

The cylinder head has a valve gear mechanism with a gas in outlet valve 31 and valve drives 32, 33. The cylinder 3 head also has an injection valve 34 and a spark plug 35. The injection valve can alternatively also be arranged in the intake duct.

The exhaust gas manifold 4 has a catalytic converter 40, preferably configured as a three-way catalytic converter. An exhaust gas return line can run from the exhaust gas manifold 4 to the intake manifold 1, in particular to the collector 12.

A control device 6 is also provided, to which sensors are assigned, which detect the various measurement variables and determine the measured value of each measurement variable. The control device 6 determines manipulated variables as a function of at least one of the measurement variables and these are then converted to one or a plurality of actuating signals to control the final control elements by means of corresponding actuators.

The sensors are a pedal position sensor 71, which detects the position of an accelerator pedal 7, an air mass sensor 14, which detects a mass air flow upstream from the throttle valve 11, a temperature sensor 15, which detects the intake air temperature, a pressure sensor 16, which detects the suction pipe pressure, a crankshaft angle sensor 22, which detects a crankshaft angle, a further temperature sensor 23, which detects a coolant temperature, a camshaft angle sensor 36, which detects the camshaft angle and an exhaust gas probe 41, which detects a residual oxygen content in the exhaust gas and the measurement signal of which is characteristic of the air/fuel ratio in the cylinder Z1. The exhaust gas probe 41 is preferably configured as a linear lambda probe and therefore generates a measurement signal proportional to the air/fuel ratio over a wide air/fuel ratio range.

Any subset of the above sensors or even additional sensors may be present depending on the embodiment of the invention.

The final control elements are for example the throttle valve 11, the gas inlet and outlet valves 30, 31, the injection valve 34, the spark plug 35 and the pulse charging valve 18.

Further cylinders Z2-Z4, to which corresponding final control elements are then also assigned, are also provided in addition to the cylinder Z1. One exhaust gas probe is preferably assigned to each bank of cylinders.

Figure 2:
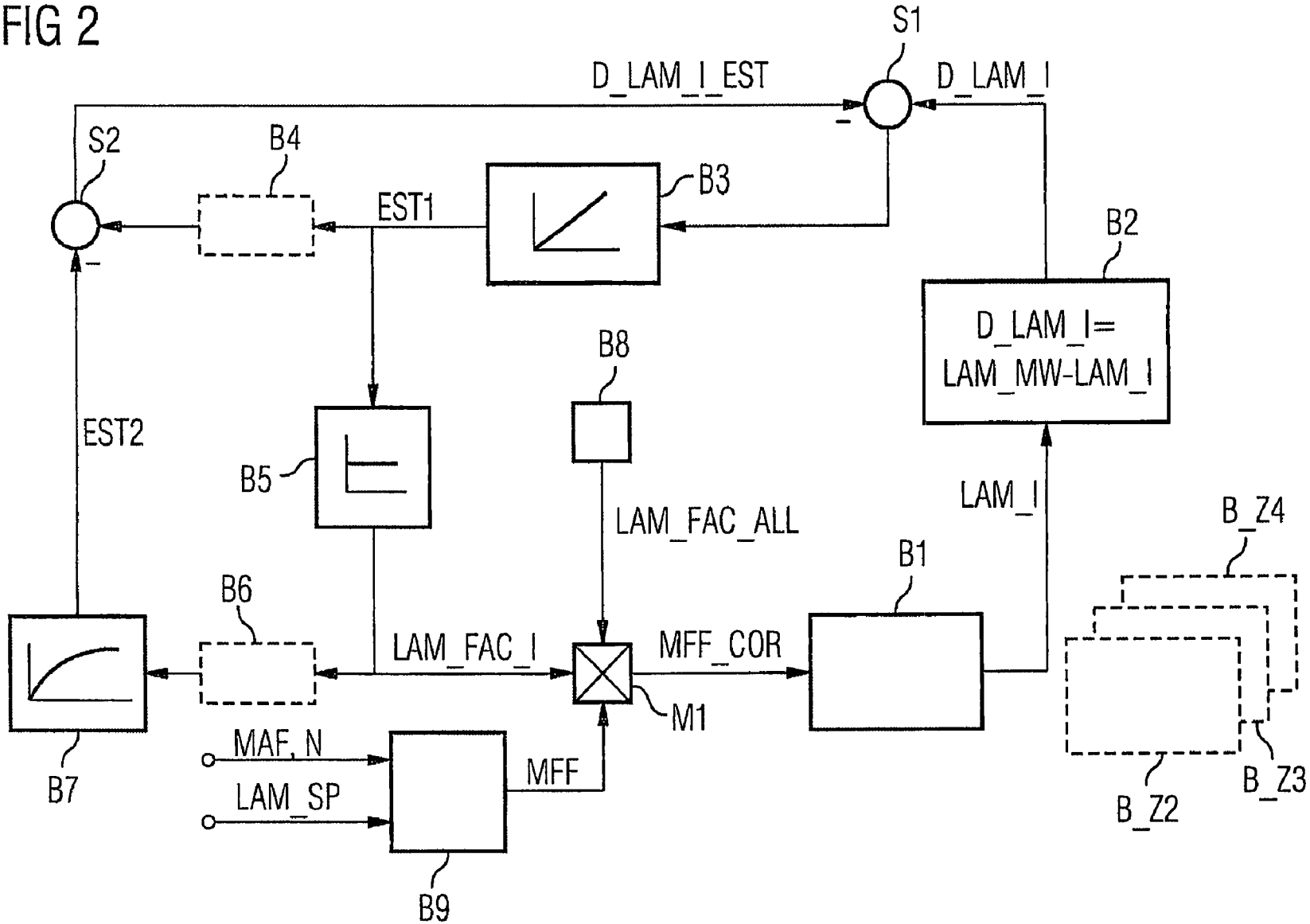
FIG. 2 shows a block circuit diagram of the control device.

A block circuit diagram of the control device 6, which can also be referred to as a device for controlling the internal combustion engine, is shown using FIG. 2. The block circuit diagram shows the blocks of the control device 6 that are relevant in relation to the invention. A block B1 corresponds to the internal combustion engine.

An air/fuel ratio LAM_I detected for a specific cylinder is supplied to a block B2 as an input variable. The air/fuel ratio LAM_I detected for a specific cylinder is derived from the measurement signal of the exhaust gas probe 41 within a predefinable time or crankshaft angle window, which is assigned to the exhaust gas produced in the respective cylinder.

In the block B2 a mean air/fuel ratio LAM_MW is determined by taking the mean of the air/fuel ratios LAM_I detected specifically for each individual cylinder Z1 to Z4 in the internal combustion engine. An actual value D_LAM_I of a cylinder-specific air/fuel ratio deviation is also determined in the block B2 from the difference between the mean air/fuel ratio LAM_MW and the air/fuel ratio LAM_I detected for a specific cylinder.

The difference between the actual value D_LAM_I and an estimated value D_LAM_I_EST of the cylinder-specific air/fuel ratio deviation is determined at a summing point S1 and then assigned to a block B3, having a first regulator, the input variable of which is then the regulating difference of said first regulator. The first regulator is configured as an integral regulator, in other words it has an integral regulating parameter. The manipulated variable of the first regulator is a first estimated value EST1.

The first estimated value EST1 is preferably multiplied in a block B4 by a weighting factor, which takes into account the fact that the regulating difference at the input of the first regulator is also influenced by the exhaust gases from other cylinders Z1 to Z4 due to the different lengths of the outlets of the cylinders Z1 to Z4 to the exhaust gas probe 41 and a mix of the exhaust gases from the individual cylinders Z1 to Z4 in the area of the exhaust gas probe 41. The thus corrected first estimated value EST1 is then supplied to a summing point S2. Alternatively the first estimated value EST1 can also be supplied directly from the block B3 to the summing point S2.

A block B5 has a second regulator, the regulating difference of which is the first estimated value EST1 and which is configured as a P regulator, i.e. it has a proportional regulating parameter. The manipulated variable of the second regulator is a cylinder-specific lambda control factor LAM_FAC_I. This cylinder-specific lambda control factor LAM_FAC_I is preferably corrected via a block B6, which corresponds to the block B4, by means of a further weighting factor and then supplied to a block B7, which has a PT1 filter, which filters the cylinder-specific lambda control factor LAM_FAC_I, thereby making a second estimated value EST2 available at its output. At the summing point S2 the estimated value D_LAM_I_EST of the cylinder-specific air/fuel ratio deviation is determined from the difference between the first and second estimated values EST1, EST2.

A third regulator is provided in a block B8, the reference variable of which is an air/fuel ratio predefined for all the cylinders in the internal combustion engine and the controlled variable of which is the mean air/fuel ratio LAM_MW. The manipulated variable of the third regulator is a lambda control factor LAM_FAC_ALL. The third regulator therefore has the task of setting the predefined air/fuel ratio over all the cylinders Z1 to Z4 of the internal combustion engine. This can alternatively be achieved by determining the actual value D_LAM_I of the cylinder-specific air/fuel ratio deviation in the block B2 from the difference between the air/fuel ratio predefined for all the cylinders Z1 to Z4 in the internal combustion engine and the cylinder-specific air/fuel ratio LAM_I. There is then no need for the third regulator of the block B8.

In a block B9 a fuel mass MFF to be metered is determined as a function of a mass air flow MAF in the respective cylinders Z1 to Z4 and in some instances the speed N and a target value LAM_SP for the air/fuel ratio for all the cylinders Z1-Z4.

A corrected fuel mass MFF_COR to be metered is determined at the multiplying point MI by multiplying the fuel mass MFF to be metered, the lambda control factor LAM_FAC_ALL and the cylinder-specific lambda control factor LAM_FAC_I. An actuating signal is then generated as a function of the corrected fuel mass MFF_COR to be metered and this activates the respective injection valve 34.

In addition to the regulator structure shown in the block circuit diagram in FIG. 2, corresponding regulator structures B_Z2 to B_Z4 for the respective further cylinders Z2 to Z4 are provided for each further cylinder Z1 to Z4.

The second estimated value EST2 compensates for the controlled system dynamic, i.e. the dynamic of the internal combustion engine in the form that the actuating interventions of the first and second regulators are taken into account in the determination of the estimated value D_LAM_I_EST of the cylinder-specific air/fuel ratio deviation. It is possible to ensure by means of the regulator structure and appropriate parameterization of the first and second regulators that the residual regulating deviation between the fuel masses actually metered to the individual cylinders Z1 to Z4 approaches zero.

Because the second regulator, the controlled variable of which is the first estimated value EST1, has no further I element, the possible regulating speed and robustness of the regulating structure are increased compared with when the second regulator also has an I element.

The weighting factor of the block B6 can also have a minus sign. This then means that the second estimated value EST2 is added at the summing point S2.

The weighting factors of the blocks B4 and/or B6 are also preferably a function of the load variable, which is preferably the mass air flow MAF in the respective cylinders Z1-Z4 and/or the speed N.

The regulating parameter of the second regulator, i.e. in this instance the proportional regulating parameter, can also be a function of the load variable, which is preferably the mass air flow MAF in the respective cylinders Z1-Z4 and/or the speed N. This allows the regulating quality to be enhanced in a simple fashion, as the different mix of the exhaust gases resulting from the individual combustion of the air/fuel mixtures in the respective cylinders Z1-Z4 can be taken into account.

Figure 3:
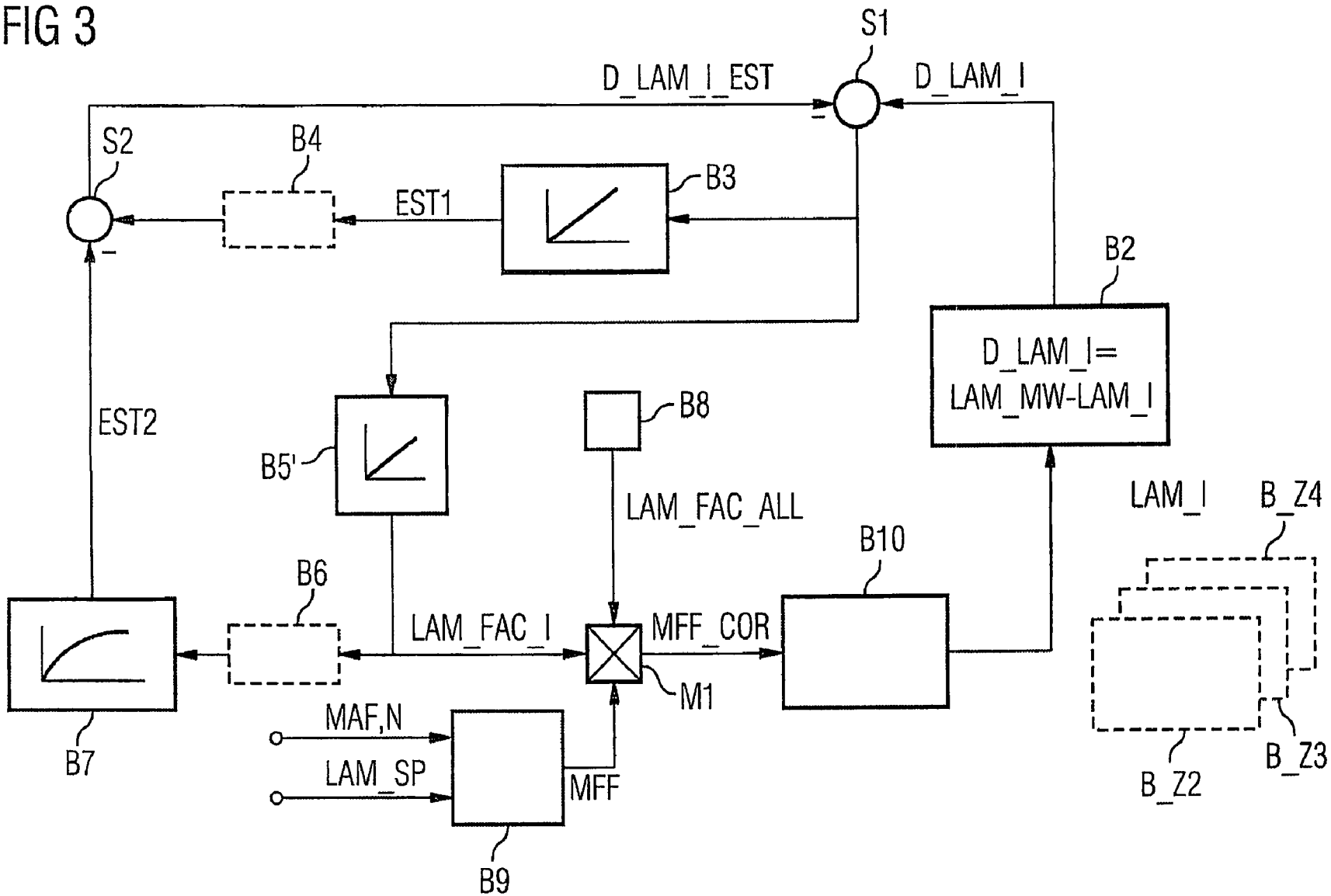
FIG. 3 shows a further block circuit diagram of the control device.

An alternative embodiment of the control device 6 is described using the block circuit diagram in FIG. 3, with only differences compared with the block circuit diagram according to FIG. 2 being examined below. Unlike the second regulator in FIG. 2, the second regulator in a block B5' has the difference between the actual value D_LAM_I and the estimated value LAM_I_EST of the cylinder-specific air/fuel ratio deviation as its regulating difference. The second regulator of the block B5' also has a further integral regulating parameter, which is preferably selected such that it corresponds to the product of the integral regulating parameter of the first regulator of the block B3 and the proportional regulating parameter of the second regulator of the block B5 in FIG. 2. The manipulated variable of the second regulator is also the cylinder-specific lambda control factor LAM_FAC_I.

Both the cylinder-specific lambda control factor LAM_FAC_I and the lambda control factor LAM_FAC_ALL can also be corresponding additive correction values for the fuel mass MFF to be metered.

The invention claimed is:

1. A device for controlling an internal combustion engine, comprising:

a plurality of cylinders and injection valves that meter fuel assigned to the cylinders;

an exhaust gas probe arranged in an exhaust gas manifold and having a measurement signal that is characteristic of the air/fuel ratio in the respective cylinder;

a first regulator is provided for regulating a difference that is the difference between an actual value and an estimated value of a cylinder-specific deviation of the air/fuel ratio from a predefinable air/fuel ratio that has an integral regulating parameter and a manipulated variable that is a first estimated value;

a second regulator is provided for regulating a difference between the first estimated value and an air/fuel ratio and has a proportional regulating parameter and the manipulated variable that is a cylinder-specific lambda control factor;

a PT1 filter is provided and a second estimated value is determined by PT1 filtering of the cylinder-specific lambda control factor;

a unit is provided that determines the estimated value of the cylinder-specific deviation of the air/fuel ratio from the difference between the first and second estimated values; and an element is provided that determines a fuel mass to be supplied to the respective cylinder in the internal combustion engine as a function of a load variable and in which the fuel mass to be supplied is corrected as a function of the cylinder-specific lambda control factor and generates an actuating signal to control the injection valve as a function of the corrected fuel mass to be supplied.

2. The device according to claim 1, wherein an element is provided that adjusts the first estimated value by a weighting factor before it is supplied to the unit and that a further element is provided that adjusts the cylinder-specific lambda control factor by a further weighting factor before it is supplied to the PT1 filter.

3. The device according to claim 1, wherein the predefinable air/fuel ratio is a mean air/fuel ratio of all cylinder-specific air/fuel ratios.

4. The device according to claim 1, wherein a third regulator is provided and the reference variable of which is an air/fuel ratio predefined for all the cylinders in the internal combustion engine and the controlled variable of which is the mean air/fuel ratio of all cylinder-specific air/fuel ratios and the manipulated variable of which is a lambda control factor.

5. The device according to claim 1, wherein the proportional regulating parameter or the further integral regulating parameter of the second regulator is predefined as a function of load.

6. A device for controlling an internal combustion engine, comprising:

a plurality of cylinders and injection valves that meter fuel assigned to the cylinders;

an exhaust gas probe arranged in an exhaust gas manifold and having a measurement signal that is characteristic of the air/fuel ratio in the respective cylinder;

a first regulator is provided for regulating a difference that is the difference between an actual value and an estimated value of a cylinder-specific deviation of the air/fuel ratio from a predefinable air/fuel ratio that has an integral regulating parameter and a manipulated variable that is a first estimated value;

a second regulator is provided for regulating the difference between an actual value and an estimated value of a cylinder-specific deviation of the air/fuel ratio from a predefinable air/fuel ratio that has a further integral regulating parameter and the manipulated variable of which is a cylinder-specific lambda control factor;

a PT1 filter is provided and a second estimated value is determined by PT1 filtering of the cylinder-specific lambda control factor;

a unit is provided that determines the estimated value of the cylinder-specific deviation of the air/fuel ratio from the difference between the first and second estimated values; and an element is provided that determines a fuel mass to be supplied to the respective cylinder in the internal combustion engine as a function of a load variable and in which the fuel mass to be supplied is corrected as a function of the cylinder-specific lambda control factor and generates an actuating signal to control the injection valve as a function of the corrected fuel mass to be supplied.

7. The device according to claim 6, wherein an element is provided that adjusts the first estimated value by a weighting factor before it is supplied to the unit and that a further element is provided that adjusts the cylinder-specific lambda control factor by a further weighting factor before it is supplied to the PT1 filter.

8. The device according to claim 6, wherein the predefinable air/fuel ratio is a mean air/fuel ratio of all cylinder-specific air/fuel ratios.

9. The device according to claim 6, wherein a third regulator is provided and the reference variable of which is an air/fuel ratio predefined for all the cylinders in the internal combustion engine and the controlled variable of which is the mean air/fuel ratio of all cylinder-specific air/fuel ratios and the manipulated variable of which is a lambda control factor.

10. The device according to claim 6, wherein the proportional regulating parameter or the further integral regulating parameter of the second regulator is predefined as a function of load.

* * * * *